US007588016B2

(12) United States Patent
Pauer

(10) Patent No.: US 7,588,016 B2
(45) Date of Patent: Sep. 15, 2009

(54) FUEL INJECTION APPARATUS FOR A MULTICYLINDER INTERNAL COMBUSTION ENGINE

(75) Inventor: Thomas Pauer, Freiberg (DE)

(73) Assignee: Robert Bosch GmbH, Stuttgart (DE)

( * ) Notice: Subject to any disclaimer, the term of this patent is extended or adjusted under 35 U.S.C. 154(b) by 140 days.

(21) Appl. No.: 11/813,558

(22) PCT Filed: Jan. 25, 2006

(86) PCT No.: PCT/EP2006/050448

§ 371 (c)(1),
(2), (4) Date: Jul. 9, 2007

(87) PCT Pub. No.: WO2006/100142

PCT Pub. Date: Sep. 28, 2006

(65) Prior Publication Data

US 2008/0184962 A1 Aug. 7, 2008

(30) Foreign Application Priority Data

Mar. 21, 2005 (DE) ..... 10 2005 012 928

(51) Int. Cl.
*F02M 69/46* (2006.01)
*F02M 61/14* (2006.01)

(52) U.S. Cl. ..... 123/456; 123/470

(58) Field of Classification Search ..... 123/456, 123/468, 469, 470, 447
See application file for complete search history.

(56) References Cited

U.S. PATENT DOCUMENTS 3,776,209 A * 12/1973 Wertheimer et al. ..... 123/470
3,835,819 A * 9/1974 Anderson, Jr. ..... 123/406.47
3,930,483 A * 1/1976 Blisko et al. ..... 123/457
4,884,545 A 12/1989 Mathis
4,913,119 A * 4/1990 Usui ..... 123/456
5,058,555 A * 10/1991 Haboush et al. ..... 123/470
5,261,375 A * 11/1993 Rush et al. ..... 123/470
5,445,019 A * 8/1995 Glidewell et al. ..... 73/114.51
5,535,621 A * 7/1996 Glidewell et al. ..... 73/114.49
5,592,968 A * 1/1997 Nakashima et al. ..... 137/561 A
6,000,380 A * 12/1999 Weisbarth ..... 123/456
6,220,224 B1 * 4/2001 Matthies et al. ..... 123/468
6,776,140 B2 * 8/2004 Maier et al. ..... 123/456
7,025,045 B2 * 4/2006 Hlousek ..... 123/447
2004/0187848 A1 9/2004 Hlousek

FOREIGN PATENT DOCUMENTS

EP 0 299 337 A2 1/1989
EP 1 260 704 A1 11/2002
WO WO 2004/013487 A1 2/2004
WO WO 2005/042966 A1 5/2005

* cited by examiner

*Primary Examiner*—Thomas N Moulis
(74) *Attorney, Agent, or Firm*—Ronald E. Greigg

(57) ABSTRACT

The fuel injection apparatus has a high-pressure pump and has a respective injector for each cylinder of the engine, which injector is at least indirectly connected to the high-pressure pump via a hydraulic line. Each injector is connected to the high-pressure pump via a hydraulic line and/or to the injector of another cylinder of the engine. This makes it possible to eliminate the high-pressure accumulator that is usually provided between the high-pressure pump and the injectors.

10 Claims, 4 Drawing Sheets

FUEL INJECTION APPARATUS FOR A MULTICYLINDER INTERNAL COMBUSTION ENGINE

CROSS-REFERENCE TO RELATED APPLICATION

This application is a 35 USC 371 application of PCT/EP 2006/050448 filed on Jan. 25, 2006.

BACKGROUND OF THE INVENTION

1. Field of the Invention

The invention relates to a fuel injection apparatus for a multicylinder internal combustion engine.

2. Description of the Prior Art

A fuel injection apparatus known from EP 0 299 337 A has a high-pressure pump that delivers fuel to a high-pressure accumulator that is also referred to as a rail. For each cylinder of an internal combustion engine, an injector is provided for fuel injection; each injector is connected to the high-pressure accumulator by means of a hydraulic line. This fuel injection apparatus has the disadvantage of high costs for production and assembly due to the presence of the high-pressure accumulator between the high-pressure pump and the injectors. Because of the high pressure that prevails in it, the high-pressure accumulator must have a high strength. In addition, the presence of the high-pressure accumulator increases the amount of space required by the fuel injection apparatus in the region surrounding the internal combustion engine.

SUMMARY AND ADVANTAGES OF THE INVENTION

The fuel injection apparatus according to the invention has the advantage over the prior art that it does not require a high-pressure accumulator, thus simplifying production and assembly as well as reducing the amount of space it requires.

BRIEF DESCRIPTION OF THE DRAWINGS

Several exemplary embodiments of the invention are explained in detail herein below, with reference to the drawings, in which.

DESCRIPTION OF THE PREFERRED EMBODIMENTS

Figure 1:
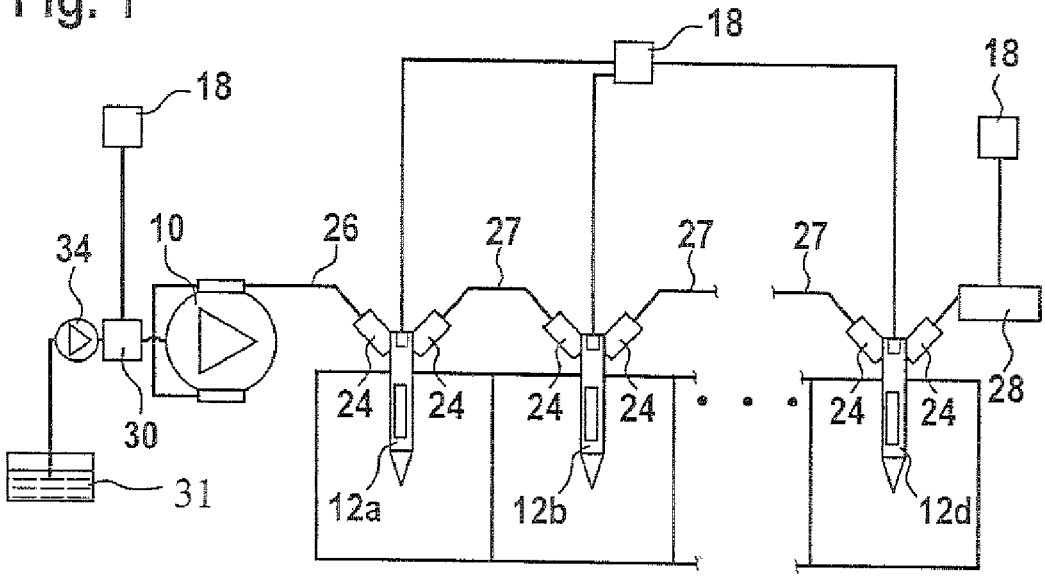
FIG. 1 is a simplified depiction of a fuel injection apparatus for an internal combustion engine according to a first exemplary embodiment.
Figure 2:
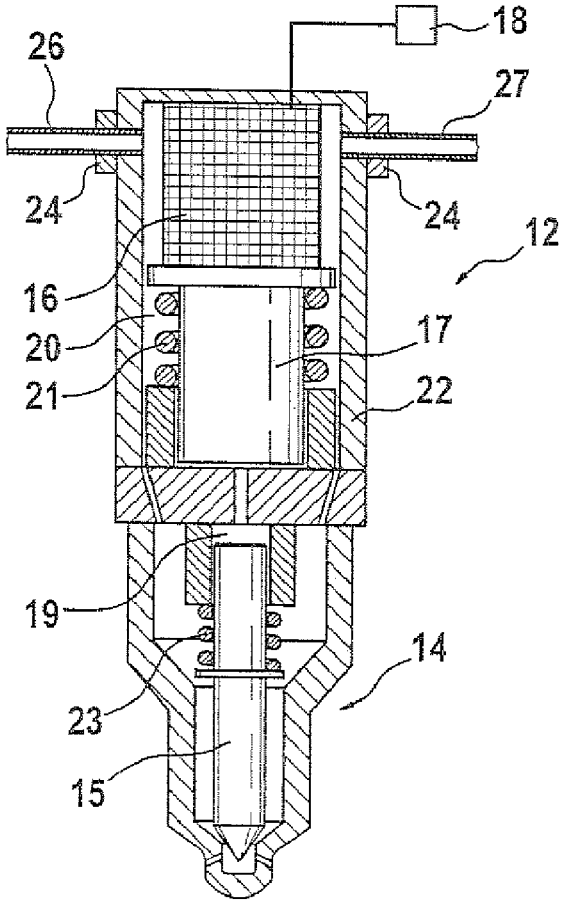
FIG. 2 is an enlarged depiction of an injector of the fuel injection apparatus.

FIGS. 1 through 10 show a fuel injection apparatus for a multicylinder internal combustion engine that is preferably an autoignition engine of a motor vehicle. The fuel injection apparatus has a high-pressure pump 10 that delivers highly pressurized fuel. Each cylinder of the engine is provided with an injector 12 that can inject fuel into the combustion chamber of the cylinder. In FIGS. 1 through 10, only some of the injectors 12 are shown; additional injectors before the last injector 12*d* are indicated by dots. As shown in FIG. 2, the injector 12 has a fuel injection valve 14, which injects fuel into the combustion chamber of the cylinder, and has an electrically triggered actuator 16. The actuator 16 controls the opening and closing motion of an injection valve member 15 of the fuel injection valve 14. Preferably, the actuator 16 is a piezoelectric actuator that changes in size depending on an electrical voltage that is applied to it. This change in size permits the execution of a switching function that can be used to open or close the injection valve member 15. An electric or electronic control unit 18 triggers the actuator 16. The actuator 16 is situated in a fuel-filled chamber 20 in a housing 22 of the injector 12. For example, the actuator 16 can act on a piston 17 that delimits a control chamber 19; the pressure prevailing in the control chamber 19 acts on the injection valve member 15 in the closing direction. A prestressed spring 21 holds the piston 17 in contact with the actuator 16. A prestressed spring 23 also acts on the injection valve member 15 in the closing direction. When the control unit 18 applies an electrical voltage to the actuator 16, the actuator expands and pushes the piston 17 toward the control chamber 19, resulting in a high pressure therein, which holds the injection valve member 15 in its closed position so that no injection of fuel occurs. If the control unit 18 does not apply any electrical voltage to the actuator 16, then the actuator contracts so that the spring 21 moves the piston 17 away from the control chamber 19, thus reducing the pressure in the control chamber 19. The high pressure acting on the injection valve member 15 in the opening direction then moves it into its open position counter to the force of the low pressure prevailing in the control chamber 19 and counter to the force of the spring 23 so that an injection of fuel occurs.

The housing 22 of the injector 12 is provided with two high-pressure connections 24 that convey highly pressurized fuel to and from the injector 12. The high-pressure connections 24 are connected to the chamber 20 that contains the actuator 16. In addition, the high-pressure connections 24 are connected via the chamber 20 to the fuel injection valve 14 in order to supply it with the fuel required for the fuel injection. The chamber 20 thus constitutes a high-pressure accumulator from which the fuel is drawn for the injection. The chamber 20 has a sufficiently large volume in order to permit it to store the volume of fuel required for the fuel injection. The chamber 20 can have a volume of between 1 and 5 $cm^3$, in particular approximately 2 $cm^3$.

In a first exemplary embodiment of the fuel injection apparatus shown in FIG. 1, only a first injector 12*a* of the injectors 12 is connected to the high-pressure pump 10; a hydraulic line 26 leading from the high-pressure outlet of the high-pressure pump 10 is connected to a high-pressure connection 24 of the injector 12*a*. Preferably, the first injector 12*a* connected to the high-pressure pump 10 is the injector situated the closest to the high-pressure pump 10 in the engine. The cylinders of the engine and therefore the injectors 12 associated with them are situated in an in-line arrangement. The other high-pressure connection 24 of the first injector 12*a* is connected to a hydraulic line 27 that leads to another injector 12*b* and is connected to a high-pressure connection 24 of said injector 12*b*. Preferably, the injector 12*b* is situated adjacent to the first injector 12*a*. The other high-pressure connection 24 of the injector 12*b* is connected to a hydraulic line 27, which in turn leads to another, preferably adjacent injector 12 and is connected to a high-pressure connection 24 of said injector 12. The last injector 12*d* is connected to the preceding adjacent injector only via a hydraulic line 27 connected to one of its two high-pressure connections 24 while a pressure sensor 28 is provided at its other high-pressure connection 24. Alternatively, the pressure sensor 28 can also be provided at another injector 12, in one of the hydraulic lines 27 between the injectors 12, in the hydraulic line 26 between the high-pressure pump 10 and the first injector 12*a*, or at the high-pressure pump 10. The injectors 12 of the cylinders of the internal combustion engine are hydraulically connected to one another in series; only the first injector 12*a* is directly connected to the high-pressure pump 10.

The pressure sensor 28 is connected to the electric control unit 18 and supplies it with a signal for the pressure that is actually prevailing in the injectors 12. On the suction side of the high-pressure pump 10, a fuel metering device 30 is provided, which can change the quantity of fuel that the high-pressure pump 10 aspirates and delivers at high pressure. The fuel metering device 30 can, for example, be used to set an adjustable flow cross section on the suction side of the high-pressure pump 10. For example, the suction side of the high-pressure pump 10 is supplied with fuel from a tank 31 by a fuel-supply pump 34; the fuel metering device 30 is situated between the fuel-supply pump 34 and the high-pressure pump 10. The control unit 18 triggers the fuel metering device 30 so that the high-pressure pump 10 supplies the injectors 12 with a highly pressurized fuel quantity that is required in order to maintain a predetermined pressure in the injectors 12 for the fuel injection.

It is possible for the high-pressure pump 10 to have only a single pump element; the hydraulic line 26 leading to the first injector 12*a* is connected to the outlet of this pump element. Alternatively, it is also possible for the high-pressure 10 to have several pump elements, for example two or three pump elements; the outlets of the pump elements are brought together at a shared connection to the high-pressure pump 10 to which is connected the hydraulic line 26 leading to the first injector 12*a*.

Figure 3:
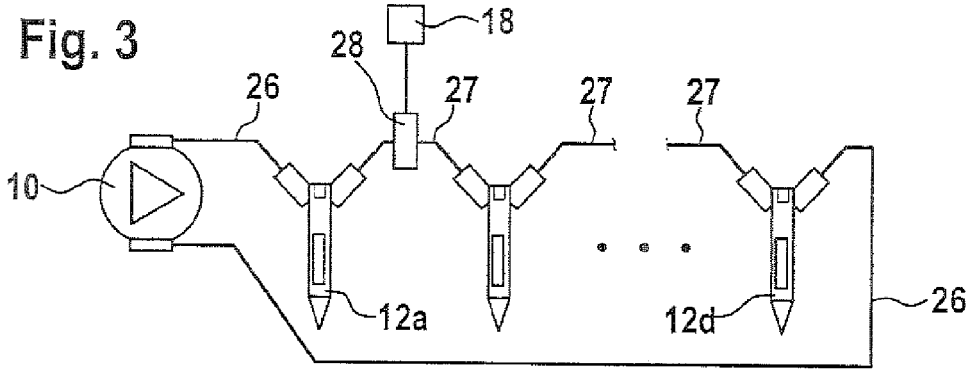
FIGS. 3 through 10 show the fuel injection apparatus according to other exemplary embodiments.

FIG. 3 shows the fuel injection apparatus according to a second exemplary embodiment whose basic design is the same as that of the first exemplary embodiment. By contrast with the first exemplary embodiment, however, in this case, the last injector 12*d* is also directly connected to the high-pressure pump 10 by means of a hydraulic line 26. As in the first exemplary embodiment, the last injector 12*d* is likewise connected to the adjacent injector via a hydraulic line 27. The high-pressure pump 10 in this case is provided with two high-pressure connections, one of which is connected to the first injector 12*a* and the other of which is connected to the last injector 12*d*. The pressure sensor 28 can be provided at one of the injectors 12, in a hydraulic line 27 between the injectors 12, in a hydraulic line 26 between the high-pressure pump 10 and one of the injectors 12, or at the high-pressure pump 10. If the high-pressure pump 10 has only one pump element, then this pump element must be provided with two high-pressure connections for attachment of the two hydraulic lines 26 leading to the respective injectors 12*a* and 12*d*. If the high-pressure pump 10 has two pump elements, then the hydraulic line 26 to the first injector 12*a* is connected to the outlet of the one pump element and the hydraulic line 26 to the last injector 12*d* is connected to the outlet of the other pump element. If the high-pressure pump 10 has more than two pump elements, then their outlets are combined to form two high-pressure connections on the high-pressure pump 10, with each high-pressure connection connected to a hydraulic line 26 that leads to an injector 12*a* or 12*d*.

Figure 4:
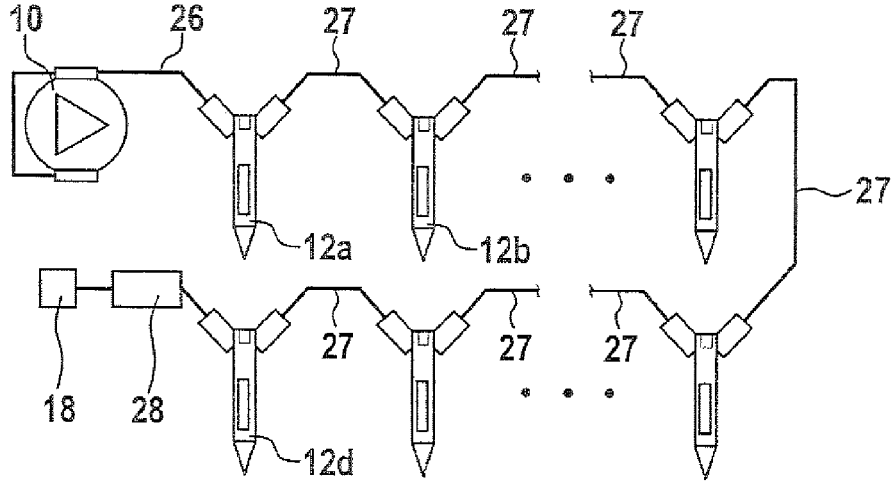

FIG. 4 shows the fuel injection apparatus according to a third exemplary embodiment in which the cylinders of the internal combustion engine are situated in a V-shaped arrangement, with several cylinders arranged in series in each cylinder row. Only the first injector 12*a* of a first cylinder row is directly connected to the high-pressure pump 10 and the remaining injectors 12 are connected to one another in series via hydraulic lines 27. The injectors 12 that are situated the farthest from the high-pressure pump 10 in the two cylinder rows are also connected to each other via a hydraulic line 27. The pressure sensor 28 is provided at the injector 12*d* that is the closest to the high-pressure pump 10 in the second cylinder row. The pressure sensor 28 can also be provided in another location, as indicated in the first exemplary embodiment. The high-pressure pump 10 is embodied as described in conjunction with the first exemplary embodiment.

Figure 5:
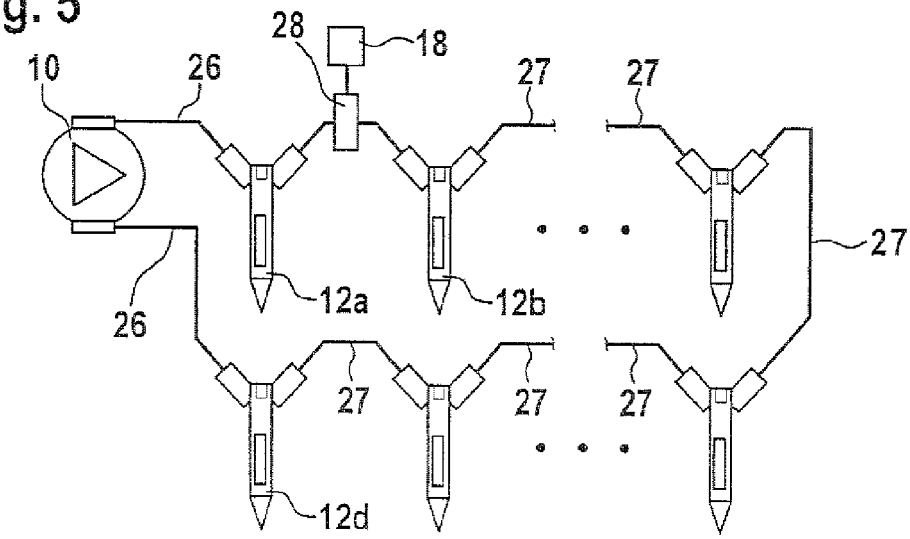

FIG. 5 shows the fuel injection apparatus according to a fourth exemplary embodiment that differs from the third exemplary embodiment only in that each of the injectors 12, which is situated the closest to the high-pressure pump 10 in each of the cylinder rows, is connected to the high-pressure pump 10 by means of a respective hydraulic line 26. The remaining injectors 12 are connected to one another in series by means of the respective hydraulic lines 27. The high-pressure pump 10 is embodied as described in conjunction with the second exemplary embodiment.

Figure 6:
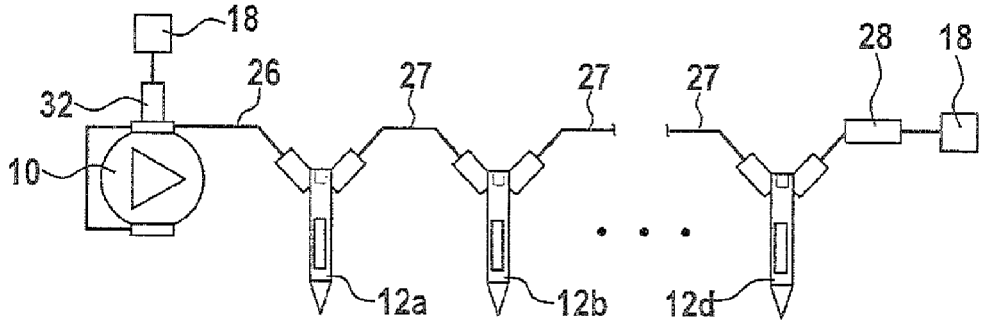
Figure 7:
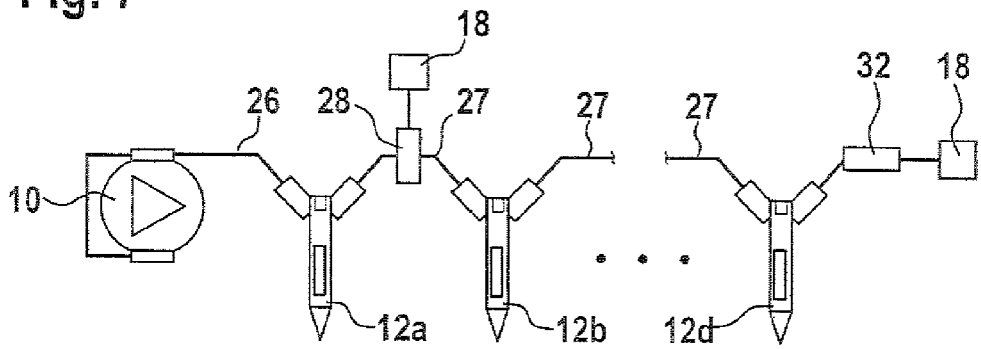

FIG. 6 shows the fuel injection apparatus according to a fifth exemplary embodiment whose basic design is the same as that of the first exemplary embodiment. The fuel injection apparatus according to the fifth exemplary embodiment is additionally provided with a pressure control valve 32 that can change the pressure prevailing in the injectors 12. The pressure control valve 32 can, for example, be provided at the high-pressure pump 10. The pressure sensor 28 can be provided at the last injector 12*d*. Alternatively, the pressure control valve 32 can also be provided at the last injector 12*d*, as in the variant depicted in FIG. 7, and the pressure sensor 28 can be provided in one of the hydraulic lines 27 between the injectors 12. The pressure control valve 32 and the pressure sensor 28 can also be mounted in any other location. The pressure control valve 32 is connected to the control unit 18, which triggers it to adjust the pressure prevailing in the injectors 12 to a predetermined value. When the control unit 18 triggers the pressure control valve 32, it is possible to change the pressure prevailing in the injectors 12 very quickly. The control unit 18 can trigger the fuel metering device 30 in such away that the high-pressure pump 10 supplies the injectors 12, at least essentially, with only the highly pressurized fuel quantity required for the fuel injection, thus making it possible to keep the output capacity of the high-pressure pump 10 to a minimum.

Figure 8:
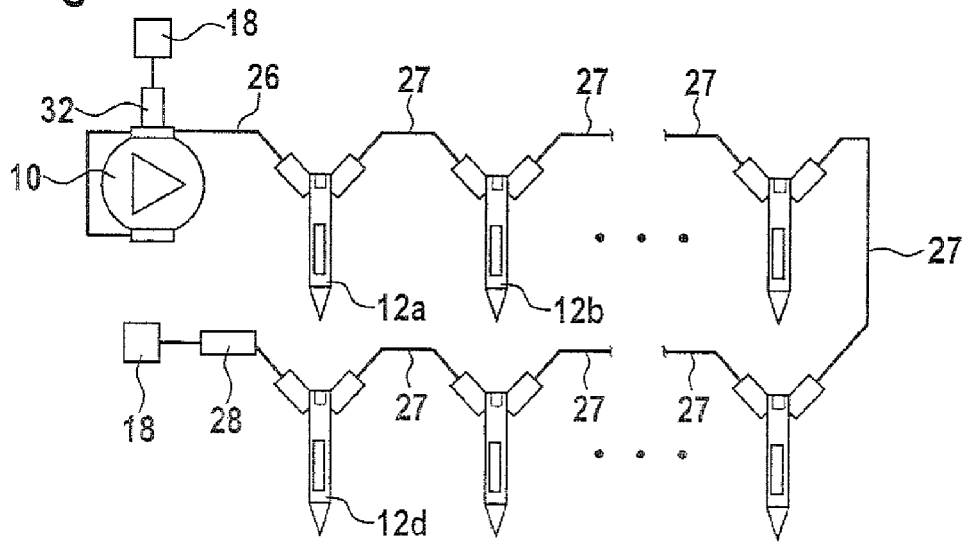
Figure 9:
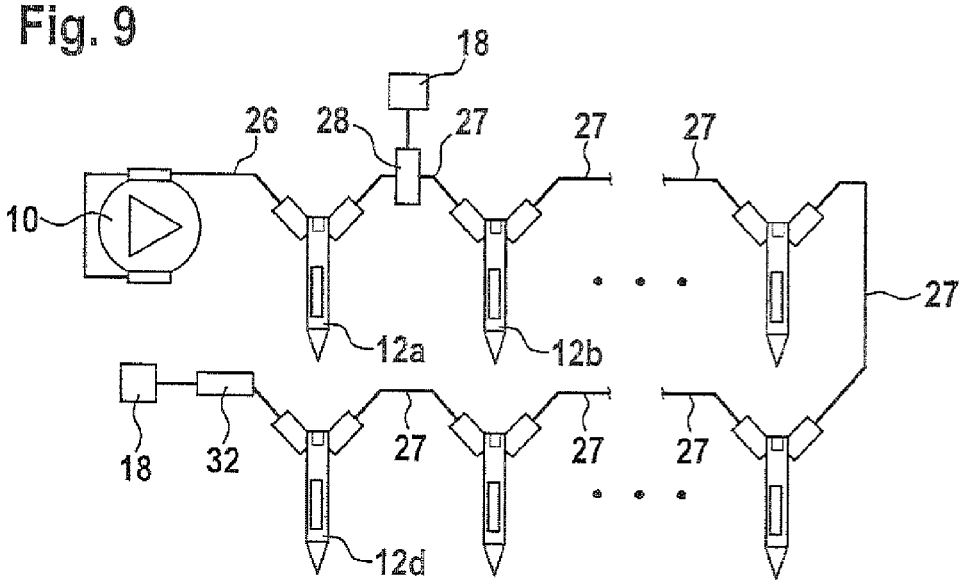

FIG. 8 shows the fuel injection apparatus according to a sixth exemplary embodiment that is embodied essentially the same as the third exemplary embodiment with the cylinders of the engine situated in a V-shaped arrangement, with the addition of the pressure control valve 32. The connection of the injectors 12 to the high-pressure pump 10 via the hydraulic line 26 and to one another via the hydraulic lines 27 is the same as in the third exemplary embodiment so that only the first injector 12*a* is directly connected to high-pressure pump 10. The pressure control valve 32 is provided, for example, at the high-pressure pump 10 and the pressure sensor 28 is provided at the last injector 12*d*. Alternatively, the pressure control valve 32 can also be provided, as in the variant depicted in FIG. 9, at the last injector 12*d* and the pressure sensor 28 can be provided in one of the hydraulic lines 27 between the injectors 12. The pressure control valve 32 and the pressure sensor 28 can also be provided in any other location.

Figure 10:
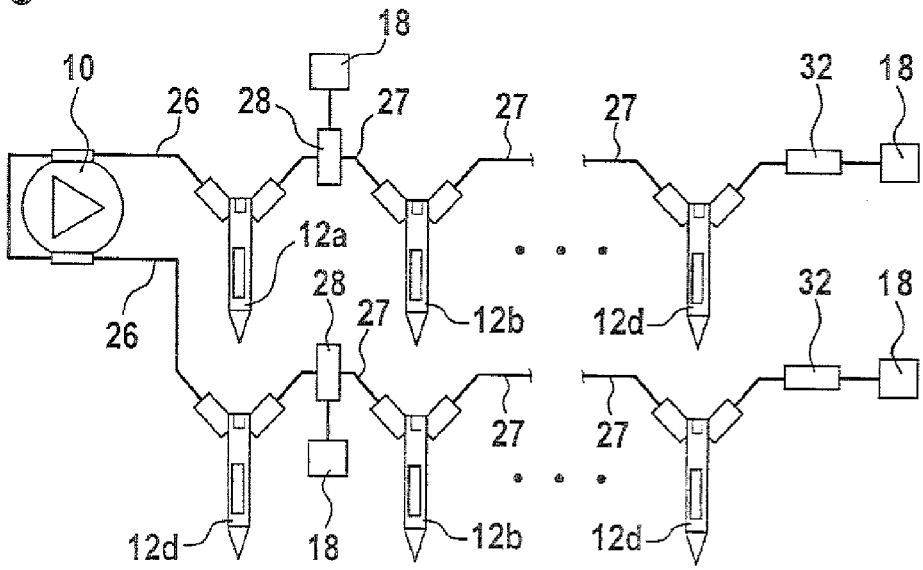

FIG. 10 shows the fuel injection apparatus according to a seventh exemplary embodiment in which, by contrast with the sixth exemplary embodiment, each of the injectors 12 that is the closest to the high-pressure pump 10 in each of the two cylinder rows is connected to the high-pressure pump 10 by means of a respective hydraulic line 26. The injectors 12*d* that are situated the farthest from the high-pressure pump 10 in the two cylinder rows are not connected to each other, but are instead each provided with a respective pressure control valve 32. A respective pressure sensor 28 is situated in one of the hydraulic lines 27 between the injectors 12 in each of the two cylinder rows. The respective pressure control valve 32 and pressure sensor 28 of the two cylinder rows can also be provided in any other location. In the seventh exemplary embodiment, there are thus separate high-pressure branches for the injectors 12 of the two cylinder rows of the engine, each row with its own pressure control valve 32 and pressure sensor 28.

The foregoing relates to a preferred exemplary embodiment of the invention, it being understood that other variants and embodiments thereof are possible within the spirit and scope of the invention, the latter being defined by the appended claims.

The invention claimed is:

1. In a fuel injection apparatus for a multicylinder internal combustion engine, having a high-pressure pump and having a respective injector for each cylinder of the engine, which injector is at least indirectly connected to the high-pressure pump via a hydraulic line, the improvement wherein each injector is connected at least indirectly to the high-pressure pump via a hydraulic line and to the injector of another cylinder of the engine, wherein each injector has at least one storage chamber that is connected to the hydraulic lines, wherein each injector has a fuel injection valve, which injects fuel into the combustion chamber of the cylinder, and an electrically triggered actuator, which controls opening and closing motion of an injection valve member of the fuel injection valve and wherein the actuator is situated in the storage chamber of the injector.

2. The fuel injection apparatus according to claim 1, wherein each injector has two high-pressure connections for the hydraulic lines.

3. The fuel injection apparatus according to claim 1, wherein the injectors are connected to one another in series via the hydraulic lines and only a first injector is directly connected to the high-pressure pump.

4. The fuel injection apparatus according to claim 2, wherein the injectors are connected to one another in series via the hydraulic lines and only a first injector is directly connected to the high-pressure pump.

5. The fuel injection apparatus according to claim 1, wherein the injectors are connected to one another in series via the hydraulic lines and a first and last injector are directly connected to the high-pressure pump.

6. The fuel injection apparatus according to claim 2, wherein the injectors are connected to one another in series via the hydraulic lines and a first and last injector are directly connected to the high-pressure pump.

7. The fuel injection apparatus according to claim 1, further comprising at least one pressure sensor connected at the high-pressure pump at one of the injectors in a hydraulic line between the injectors or in a hydraulic line between the high-pressure pump and one of the injectors.

8. The fuel injection apparatus according to claim 2, further comprising at least one pressure sensor connected at the high-pressure pump at one of the injectors in a hydraulic line between the injectors or in a hydraulic line between the high-pressure pump and one of the injectors.

9. The fuel injection apparatus according to claim 7, wherein the at least one pressure sensor is connected to an electric control unit and the high-pressure pump is preceded by a fuel metering device that is triggered by the control unit as a function of the pressure detected by the pressure sensor.

10. The fuel injection apparatus according to claim 1, further comprising at least one pressure control valve, which is triggered by an electric control unit connected at the high-pressure pump, at one of the injectors, in a hydraulic line between the injectors, or in a hydraulic line between the high-pressure pump and one of the injectors, and an electric control unit operably connected to and triggering the pressure control unit.

* * * * *